US005648792A

United States Patent [19]

Sato et al.

[11] Patent Number: 5,648,792

[45] Date of Patent: Jul. 15, 1997

[54] LIQUID CRYSTAL DISPLAY DEVICE HAVING A THIN FILM

[75] Inventors: Toshihiro Sato; Hiroko Hayata; Yuichi Numata; Takuo Kaitoh; Jun Ishikawa; Shigeo Shimomura, all of Mobara, Japan

[73] Assignee: Hitachi, Ltd., Tokyo, Japan

[21] Appl. No.: 396,604

[22] Filed: Mar. 1, 1995

[30] Foreign Application Priority Data

Mar. 14, 1994 [JP] Japan ..... 6-69127

[51] Int. Cl.[6] ..... G09G 3/36

[52] U.S. Cl. ..... 345/92; 345/100; 345/214

[58] Field of Search ..... 345/92, 100, 204, 345/214; 359/57, 85; 348/800

[56] References Cited

U.S. PATENT DOCUMENTS

| | | | |
|---|---|---|---|
| 4,922,240 | 5/1990 | Duwaer | 345/100 |
| 4,931,787 | 6/1990 | Shannon | 345/100 |
| 5,455,598 | 10/1995 | Clerc | 345/92 |

*Primary Examiner*—Victor R. Kostak

*Attorney, Agent, or Firm*—Antonelli, Terry, Stout & Kraus, LLP

[57] ABSTRACT

A TFT display device realizing a high degree of fineness by integrally forming a TFT display panel and a drive circuit therefor by using a poly-Si film. The display device comprises TFT transistors of which the gates are connected to the scanning lines and of which the drains are connected to the signal lines that are so formed as to intersect one another substantially at right angles, a TFT display panel having pixel electrodes provided at sources of the TFT transistors, a signal line drive circuit which is formed on the display panel and permits pixel signals that are serially input to be output in parallel, and a scanning line drive circuit which is formed on the display panel and simultaneously selects the two neighboring scanning lines while changing the combination thereof for each of the fields, wherein for the pixels of two rows that are simultaneously selected by the scanning line drive circuit, the signal written into the pixels corresponding to one row has a polarity opposite to that of the signal written into the pixels corresponding to the other row. Therefore, despite the two rows are simultaneously selected, signals of opposite polarities are fed to these rows, whereby flickering decreases and noise transmitted to the signal lines and to a common plate electrode is canceled, making it possible to accomplish stable display operation.

8 Claims, 8 Drawing Sheets

LIQUID CRYSTAL DISPLAY DEVICE HAVING A THIN FILM

BACKGROUND OF THE INVENTION

The present invention relates to a thin-film transistor (referred to as TFT) display device and, more specifically, to art which can be effectively utilized in a device in which a display panel of a TFT active matrix constitution and a drive circuit therefor are formed on a glass substrate.

When a TFT display device is realized in a small size, the numerical aperture becomes too small with the conventional system in which a thin amorphous silicon film is used as a channel layer of transistors. This is because, since limitation exists in the characteristics of the transistors, it is not allowed to decrease the size of the transistors.

When the transistors are formed by using the thin amorphous silicon film, furthermore, it becomes necessary to provide a peripheral drive circuit on the outside since performance of the transistors are not sufficient to drive a display device.

When the transistors are formed by using a polycrystalline silicon (referred to as poly-Si) film, it is possible to drive a display device and a drive circuit has also been formed on the same glass substrate.

The TFT elements using a poly-Si film have been used for constituting a color view finder of a small video camera having a number of pixels of about 100,000 and a diagonal length of the display area of 0.7 inches. Study has been made to utilize the TFT display device having poly-Si film as a light valve of a projector or as a panel for a head-mounted (spectacle-type) display designed for accomplishing virtual reality. The TFT display device utilizing the poly-Si film has been disclosed in, for example, "Nikkei Electronics" published by Nikkei-McGraw-Hill Co., Feb. 28, 1994, pp. 103–109.

SUMMARY OF THE INVENTION

Even in the above-mentioned TFT display device using poly-Si film, it has been desired to improve fineness and, hence, to increase the number of pixels. With the number of pixels being about 100,000, however, the number of scanning lines is about 240 and with which the picture quality is not still satisfactory for use as a light valve of a projector or as a head-mounted display. If the number of pixels is increased to about 300,000 to be utilized for such applications, the number of scanning lines must be doubled to about 480. However, since the time constituting each pixel is the same, a sufficiently high speed is not accomplished by the drive circuit using the poly-Si film when it is attempted to drive 480 scanning lines in an interlacing manner. Therefore, an external drive circuit must be provided as in the case of the TFT display device that uses amorphous silicon film. This then makes it difficult to utilize the feature of the TFT display device which uses poly-Si film.

Japanese Patent Laid-Open Nos. 225683/1984 and 4992/1985 are disclosing a large TFT display device using amorphous silicon TFTs in which the data of one scanning line is displayed on two pixel electrodes that are neighboring in the scanning direction, and display is made by changing a combination of pixels depending upon the odd-number fields and the even-number fields. According to the above display drive method, however, each pixel is substantially constituted by using two pixels and the same signal is supplied, deteriorating performance such as resolution and flickering, and making it difficult to accomplish high degree of fineness despite of the use of pixels.

The object of the present invention is to provide a TFT display device which realizes high degree of fineness by integrally forming a TFT display panel and a drive circuit therefor by using a poly-Si film.

The above and other objects as well as novel features of the present invention will become obvious from the description of the specification and the accompanying drawings.

A representative example of the invention disclosed in this application will now be briefly described below. That is, a display device comprising TFT transistors of which the gates are connected to the scanning lines and of which the drains are connected to the signal lines that are so formed as to intersect one another substantially at right angles, a TFT display panel having pixel electrodes provided at sources of the TFT transistors, a signal line drive circuit which is formed on the display panel and permits pixel signals that are serially input to be output in parallel, and a scanning line drive circuit which is formed on the display panel and simultaneously selects the two neighboring scanning lines while changing the combination thereof for each of the fields, wherein for the pixels of two rows that are simultaneously selected by the scanning line drive circuit, the signal written into the pixels corresponding to one row has a polarity opposite to that of the signal written into the pixels corresponding to the other row.

According to the above-mentioned means, despite the two rows are simultaneously selected, signals of opposite polarities are fed to these rows, whereby flickering decreases and noise transmitted to the signal lines and to a common plate electrode is canceled, making it possible to accomplish stable display operation.

DESCRIPTION OF THE PREFERRED EMBODIMENT

Figure 1:
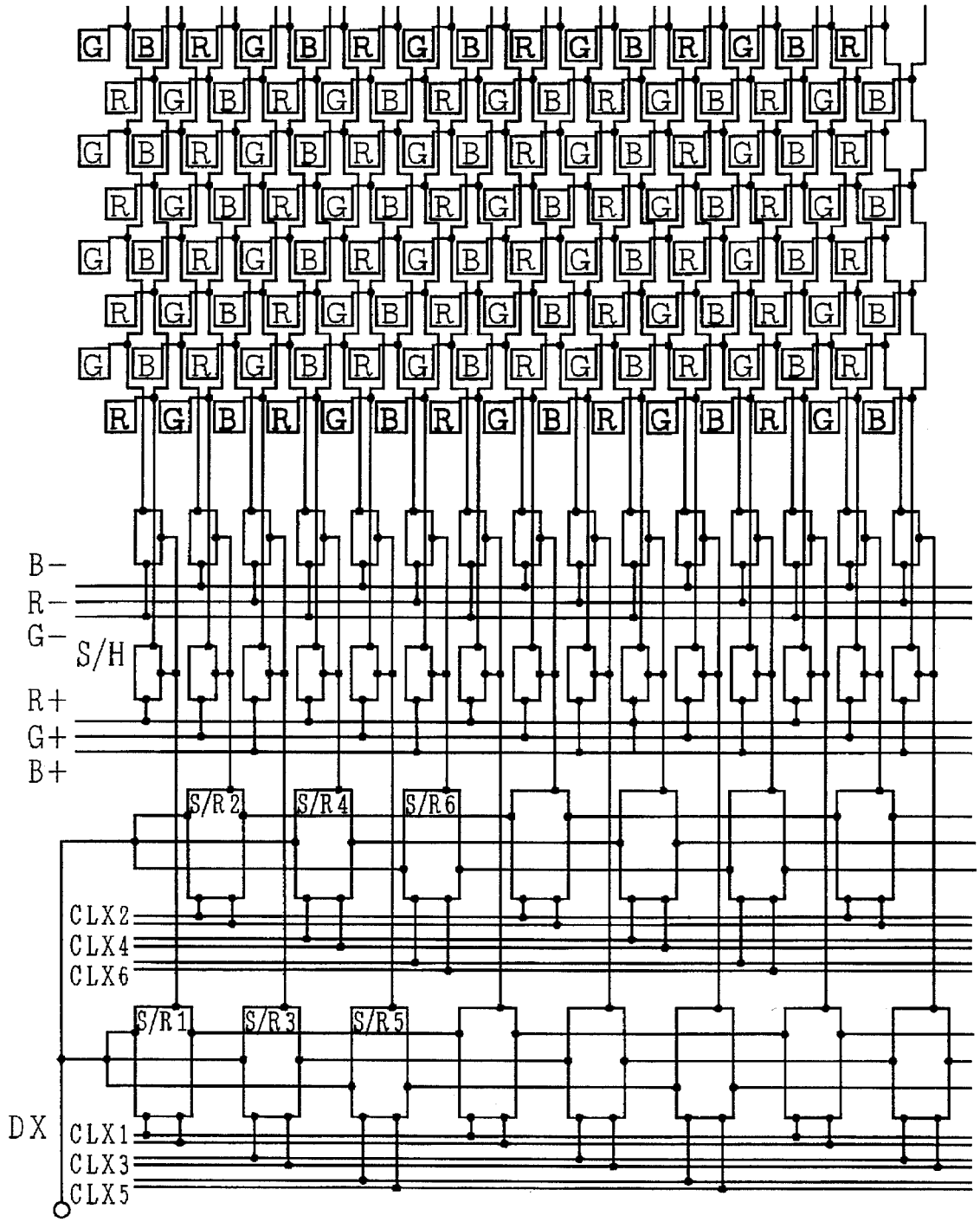
FIG. 1 is a diagram which schematically illustrates the constitution of a display unit and a signal line drive circuit in a TFT display device according to an embodiment of the present invention.

FIG. 1 is a diagram which schematically illustrates the constitution of a display unit and a signal line drive circuit in a TFT display device according to an embodiment of the present invention. Though FIG. 1 does not show the scanning line electrodes and TFT transistors in the display unit, it should be noted that the pixels arranged in the lateral direction are connected to the same scanning line electrode. TFT transistors and channel layers of p-channel and n-channel MOSFETs are formed by using a poly-Si film formed on the glass substrate (quartz substrate).

In the display unit, the color filters of the pixels are denoted by characters R, G and B. In this embodiment, the pixels are divided by a pair of signal lines (drain lines) into those of an even-number row and those of an odd-number row. Of a pair of signal lines at the left end, for instance, a pixel G of the second row from the bottom, a pixel G of the fourth row, a pixel G of the sixth row, . . . are connected to the signal line of the left side. To the other signal line are connected a pixel R of the first row from the bottom, a pixel R of the third row, a pixel R of the fifth row, . . . . To the signal line on the left side of the second pair of signal lines are connected a pixel B of the second row from the bottom, a pixel B of the fourth row, a pixel B of the sixth row, . . . and to the other signal line are connected a pixel G of the first row from the bottom, a pixel G of the third row, a pixel G of the fifth row, . . . . To the signal line on the left side of the third pair of signal lines are connected a pixel R of the second row from the bottom, a pixel R of the fourth row, a pixel R of the sixth row, . . . and to the other signal line are connected a pixel B of the first row from the bottom, a pixel B of the third row, a pixel B of the fifth row, . . . . With the above-mentioned three pairs of signal lines as a unit, the pixels are repeated maintaining the same pattern.

Of the above-mentioned pairs of signal lines, the signal lines on the left side are supplied with, for example, negative-polarity signals B–, R– and G– in synchronism with pixel clocks, and the signal lines on the right side are supplied with positive-polarity signals R+, G+ and B+ in synchronism with pixel clocks. The polarity of these signals is inverted for each of the fields so that a DC voltage will not be applied to liquid crystals. The pairs of signal lines are simultaneously selected by sample-holding circuits S/H made up of switching MOSFETs which are simultaneously controlled for their switching operation by shift registers that will be described below, and are supplied with the signals B–, R–, G–, B+, R+ and G+.

In order to successively select the signal lines from the left toward the right though there is no particular limitation, there are provided three shift registers for the odd-number signal lines and another three shift registers for the even-number signal lines. The shift registers S/R1, S/R3 and S/R5 are for the odd-number signal lines, a start pulse DX is fed in common, and outputs of a first stage of the shift registers form selection signals corresponding to the first, third and fifth signal lines. A second-stage circuit of the shift register S/R1 forms a selection signal for a seventh signal line, a second-stage circuit of the shift register S/R3 forms a selection signal for a ninth signal line, and a second-stage circuit of the shift register S/R5 forms a selection signal for an eleventh signal line. That is, the shift registers for the odd-number signal lines form selection signals for every three signal lines of odd numbers.

The shift registers S/R2, S/R4 and S/R6 are for the even-number signal lines, a start pulse DX is fed in common, and outputs of a first stage of the shift registers form selection signals corresponding to the second, fourth and sixth signal lines. A second-stage circuit of the shift register S/R2 forms a selection signal for an eighth signal line, a second-stage circuit of the shift register S/R4 forms a selection signal for a tenth signal line, and a second-stage circuit of the shift register S/R6 forms a selection signal for a twelfth signal line. That is, the shift registers for the even-number signal lines form selection signals for every three signal lines of even numbers.

With the shift register being divided into six as described above, the shift clocks CLX1 to CLX6 are formed by dividing the frequency of pixel clocks into one-sixth. The shift registers S/R1 to S/R6 successively effect the shifting operation at a slow period which is one-sixth that of the pixel clocks, whereby the selection signals are formed each being deviated by one pixel clock. Therefore, the sample-holding circuits S/H which transmit the above pixel signals to signal lines successively output to the pairs of signal lines the pixel signals that are serially input in synchronism with the pixel clocks.

The shift register uses MOSFETs that are formed by using a poly-Si film formed on the same glass substrate as the display unit as described above and, hence, exhibits poor switching characteristics compared with the MOSFETs formed on a single crystalline silicon substrate. The frequency of pixel clocks increases with an increase in the number of pixels in the display unit. By dividing the shift register as described above, therefore, the frequency of the shift clocks is lowered to one-sixth the frequency of the pixel clocks thereby to maintain a sufficiently large operation margin.

Figure 2:
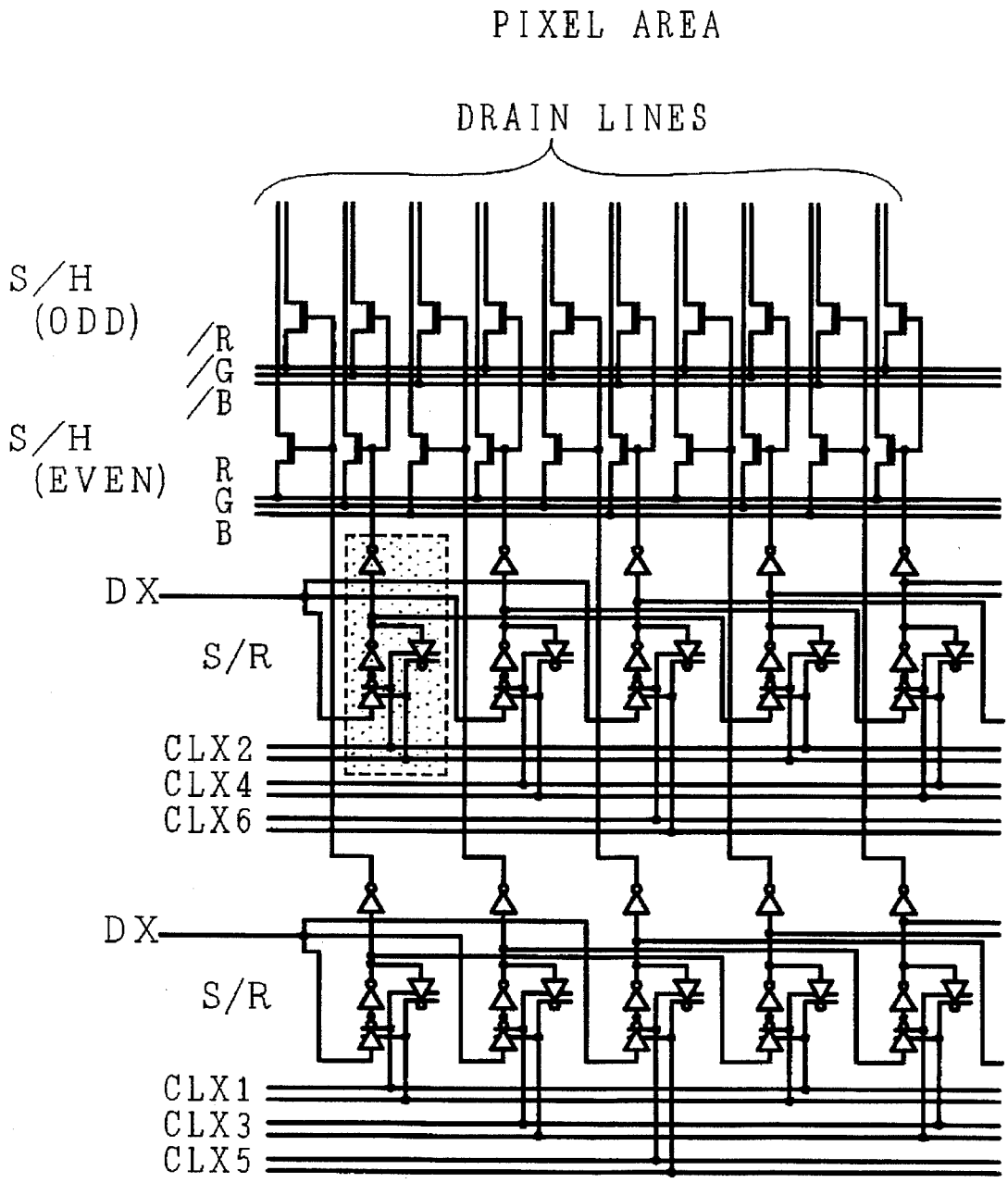
FIG. 2 is a circuit diagram illustrating a signal line drive unit in the TFT display device according to the embodiment of the present invention.

FIG. 2 is a circuit diagram illustrating a signal line drive unit according to the embodiment, wherein sample-holding circuits S/H for odd-number signal lines (ODD) and even-number signal lines (EVEN) are constituted by switching MOSFETs which are commonly supplied through the gates thereof with a selection signal formed by the shift register. The switching MOSFETs are connected to the pixel signal lines /R, /G and /B and R, G and B in conjunction with the color pixels provided to the signal lines as described above. Here, /R, /G and /B correspond to R–, G– and B– of FIG. 1, and R, G and B correspond to R+, G+ and B+.

A unit circuit of the shift register is constituted by a clocked inverter circuit for input, a latch circuit made up of an inverter circuit and a clocked inverter circuit for feedback, and an inverter circuit for output. The shift register using such clocked inverter circuits has been widely known and is not described here in detail.

Figure 8:
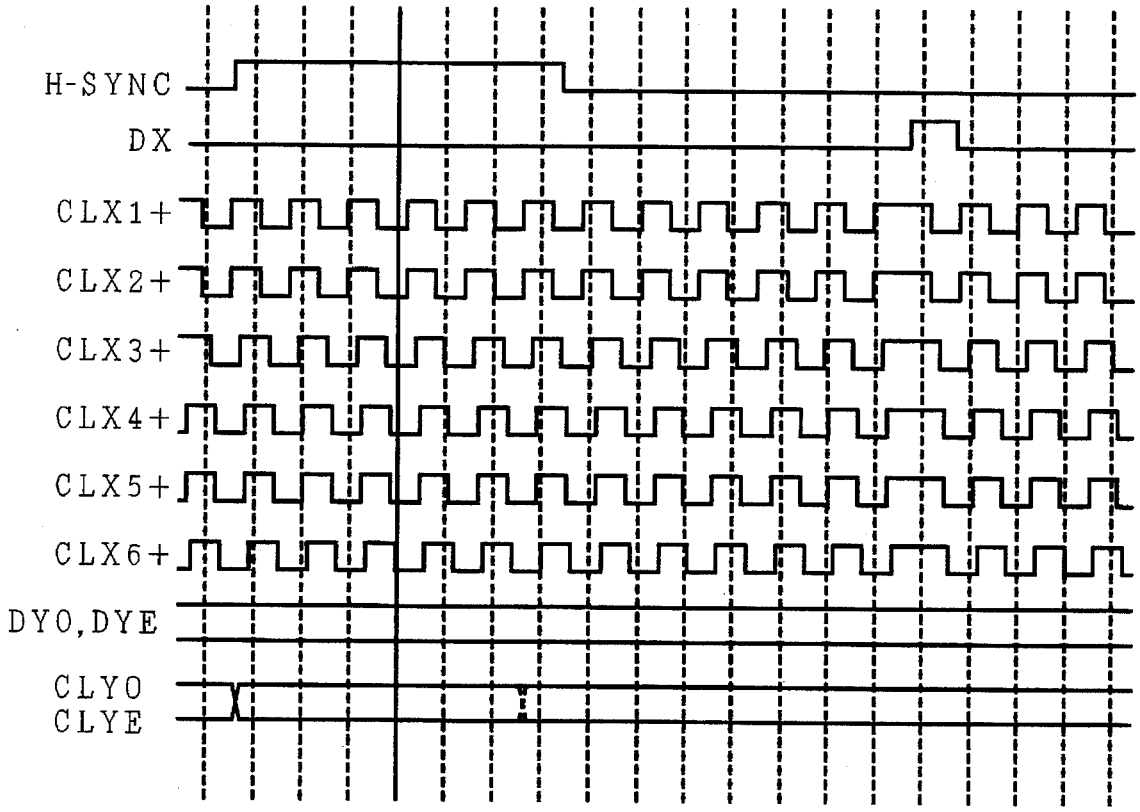
FIG. 8 is a diagram of timings for explaining part of the operation of the scanning line drive circuit in the TFT display device according to the present invention.

Signals DX are start pulses. By successively picking up and shifting the start pulses having a high level in response to the shift clocks CLX1 to CLX6, there can be formed selection signals for successively selecting the signal lines starting at the left end of the screen. The shift clocks CLX1 to CLX6 and the start pulse DX are shown in a timing diagram of FIG. 8.

When the start pulse DX corresponding to the left end of the pixels is generated after the feedback of the horizontal retrace line is finished in response to a horizontal synchronizing signal H-SYNC, selection signals are successively formed by an amount of a phase difference only in synchronism with the shift clocks CLX1 to CLX6, thereby to successively select six pairs of signal lines.

Figure 3:
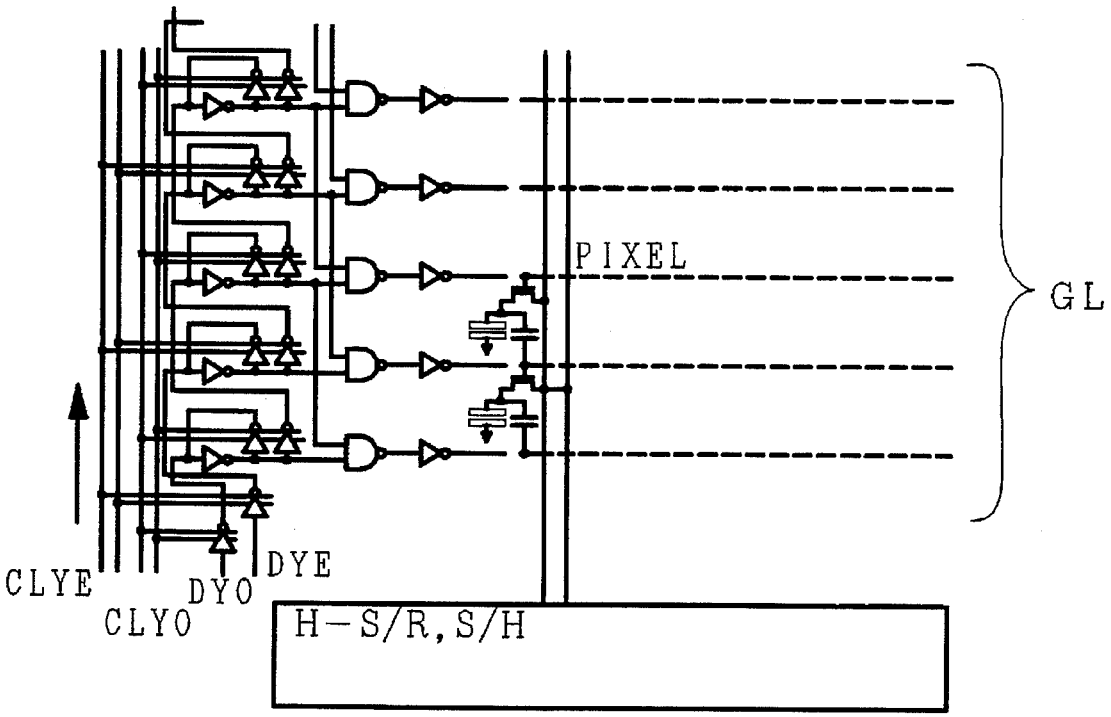
FIGS. 3(*a*) and 3(*b*) are diagrams illustrating a scanning line drive unit in the TFT display device according to the embodiment of the present invention.
Figure 3:
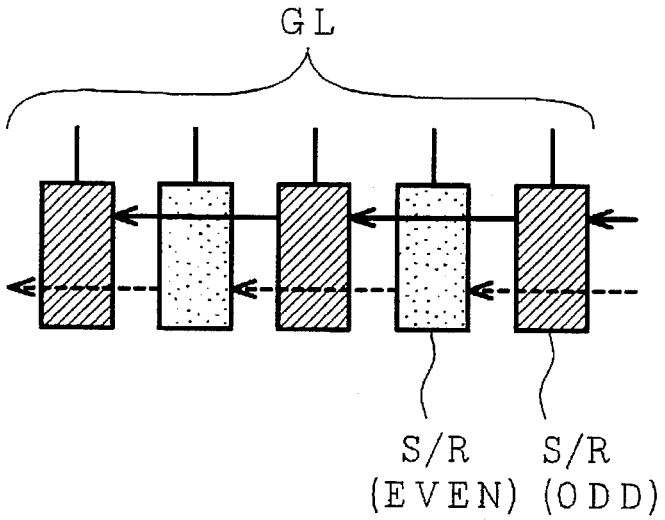

FIG. 3(*a*) and FIG. 3(*b*) are a circuit diagram illustrating a scanning line drive circuit according to the embodiment. In this embodiment, the neighboring two scanning lines are simultaneously selected while changing the combination depending upon an odd-number field (first field) and an even-number field (second field). As shown in FIG. 3(*b*), therefore, the scanning line drive circuit is constituted by two shift registers corresponding to an odd-number line and an even-number line. A unit circuit of the shift register S/R that forms signals for selecting the scanning lines GL is constituted by a clocked inverter circuit for input, a latch circuit made up of an inverter circuit and a clocked inverter circuit for feedback, and a clocked inverter circuit for output.

The shift clock is constituted by a shift clock CLYO for an odd number and a shift clock CLYE for an even number. The start pulses are separated into DYO for even numbers and DYE for even numbers in order to change the combination of rows for each of the fields.

Figure 7:
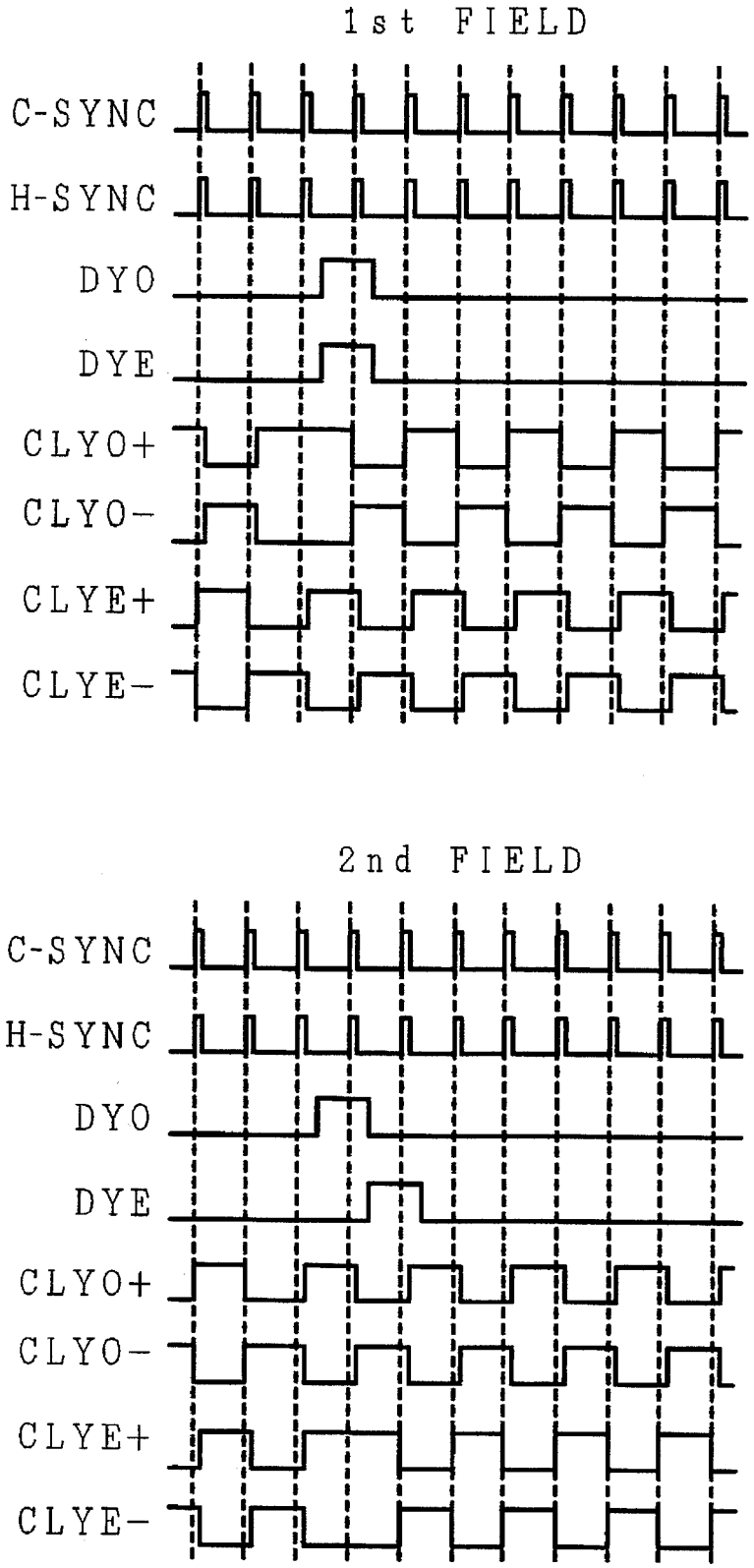
FIG. 7 is a diagram of timings for explaining part of the operation of the signal line drive circuit in the TFT display device according to the present invention.

In the first field (odd-number field) as shown in FIG. 7, the start pulses DYO and DYE are simultaneously generated. In synchronism with the shift clocks CLYO and CLYE, therefore, the scanning lines are selected in a number of two each time in a combination of the first row and the second row.

In the second field (even-number field) in FIG. 7, the start pulse DYE is generated delayed behind the start pulse DYO by a period of H-SYNC. The shift clock CLYE is inverted for its polarity. Therefore, the first row only is selected first, and, then, the scanning lines are successively selected in a number of two each time in a combination of the second row and the third row in synchronism with the shift clocks CLYO and CLYE.

In the first field in FIG. 3(*a*), the two pixels that are representatively shown are supplied with a pixel signal of negative polarity from one signal line and with a pixel signal of positive polarity from the other signal line. Compared with the conventional device in which two rows are simultaneously selected to write the same signal, therefore, the device of the present invention samples and holds the pixel signals corresponding to an odd-number row and an even-number row by changing the polarities and makes it possible to obtain a display screen having a high degree of fineness nearly corresponding to the number of pixels. Besides, since the signals fed to the signal lines have opposite polarities, noise transmitted to the common electrode is offset and affects little.

Figure 4:
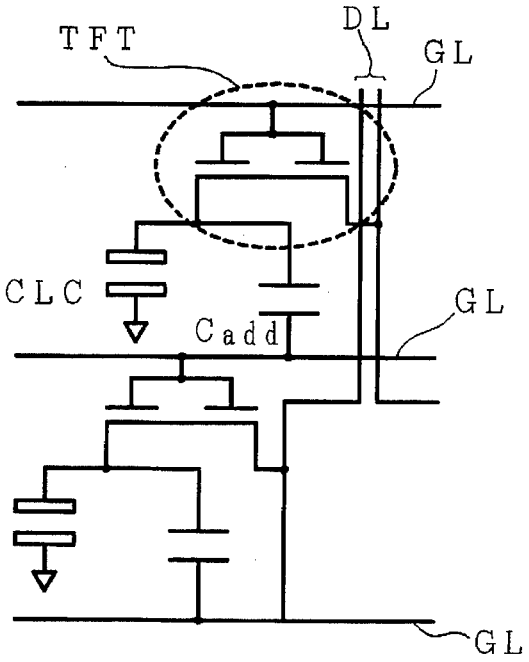
FIGS. 4(*a*) and 4(*b*) are diagrams illustrating the constitution of the display unit according to the embodiment of the present invention.
Figure 4:
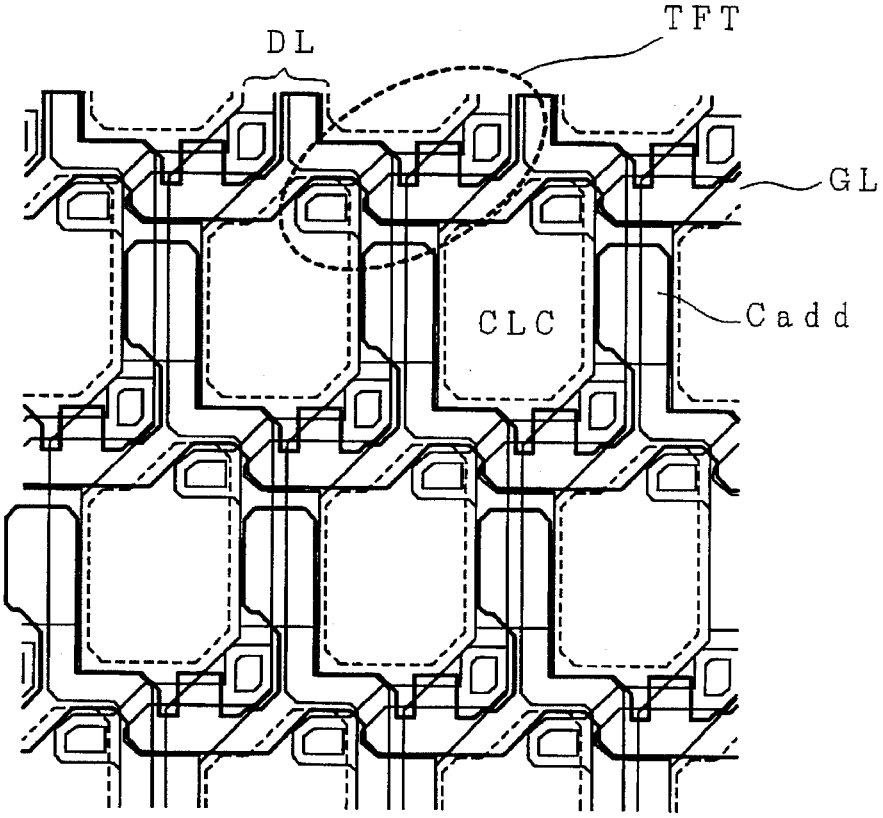
Figure 5A:
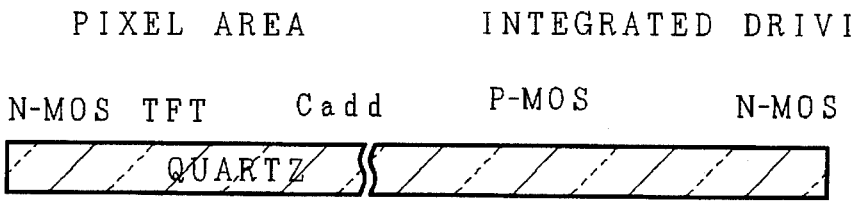
FIGS. 5(*a*)–5(*g*) are sectional views illustrating the steps for fabricating MOSFETs of the display unit and of the drive unit in the TFT display device according to the present invention.
Figure 5B:
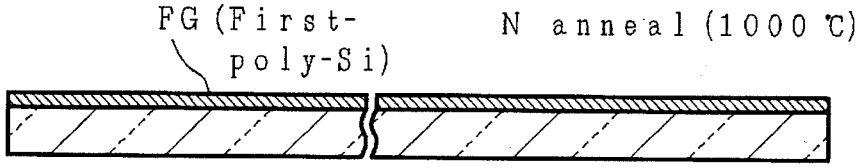
Figure 5C:
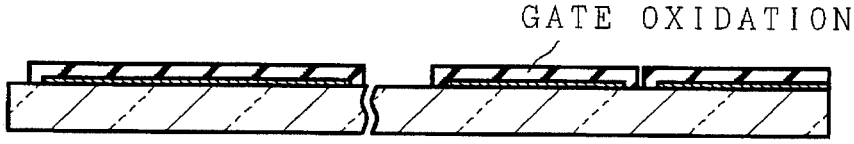
Figure 5D:
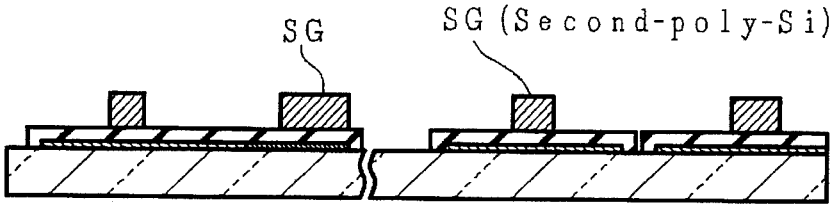
Figure 5E:
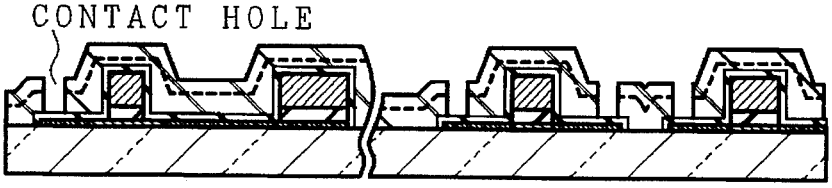
Figure 5F:
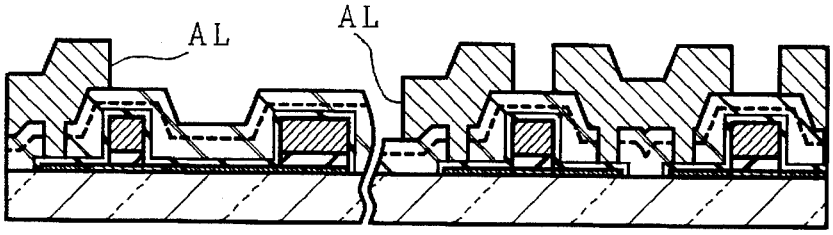
Figure 5G:
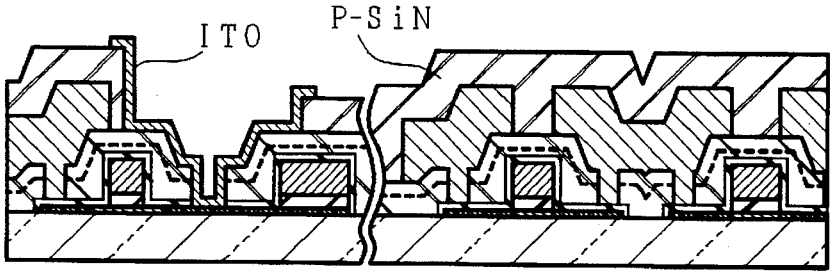

FIG. 4 is a diagram illustrating the constitution of a display unit according to the embodiment of the present invention, wherein FIG. 4(*a*) shows an equivalent circuit and FIG. 4(*b*) shows a layout of elements.

The two drain lines GL provided for an even number and an odd number are arranged in an overlapped manner on the upper portion of a holding capacity Cadd, and the combination thereof with the neighboring signal line is alternately changed for each of the rows. That is, the pair of signal lines are arranged neighboring to each other on a given row, but are divided on a next row into the right and left with a pixel electrode CLC being formed therebetween. In a portion where the pixel electrode is formed, the pair of signal lines are arranged being neighbored to one of the neighboring pairs of signal lines. In the neighboring signal line, the pixels are arranged being deviated by one row and describes the same pattern. Therefore, the aperture (CLC) of the pixel can be broadened to improve light utilization factor of the display panel. This makes it possible to solve the problem of a decrease in the brightness of the display screen inherent in a small highly fine panel.

This helps enhance performance of an electronic view finder, light bulb of a projector and head-mount display for realizing virtual reality, that require a small and highly fine display panel.

FIG. 5 is a sectional view illustrating the steps for fabricating MOSFETs in the display unit (pixel area) and in the drive unit (integrated driver) in the TFT display device.

In FIG. 5(*a*), a washed quartz substrate is prepared.

In FIG. 5(*b*), a poly-Si film which is a first layer is formed on the surface.

In FIG. 5(*c*), the poly-Si film which is the first layer is selectively removed leaving portions where elements will be formed, and a thermally oxidized film is formed on the surface thereof.

In FIG. 5(*d*), there are selectively formed a gate electrode of MOSFET, a gate electrode of TFT, and a poly-Si film which is a second layer and serves as an electrode of the capacitor Cadd. Impurities are introduced into the poly-Si layer which is the first layer serving as the other electrode of the capacitor Cadd, in order to decrease the resistance. By using the gate electrodes as masks, impurities are introduced into the poly-Si film which is the first layer to form source and drain regions.

In FIG. 5(*e*), an interlayer insulating film is formed, and contact holes are formed in the signal lines and in the source and drain of MOSFET.

In FIG. 5(*f*), there are formed signal lines composed of aluminum, signal lines connected to the source and drain of MOSFETs constituting a drive circuit, and power source lines.

In FIG. 5(*g*), a P-SiN which is a protection fill is formed, part of the P-SiN film is selectively removed from the image display region (pixel area), a portion where an Al (aluminum) pattern comes into contact with an external connection terminal is removed, a contact hole is formed in a portion of the source electrode in the image display region and, finally, a transparent electrode fill ITO is formed to complete the TFT substrate.

Figure 6:
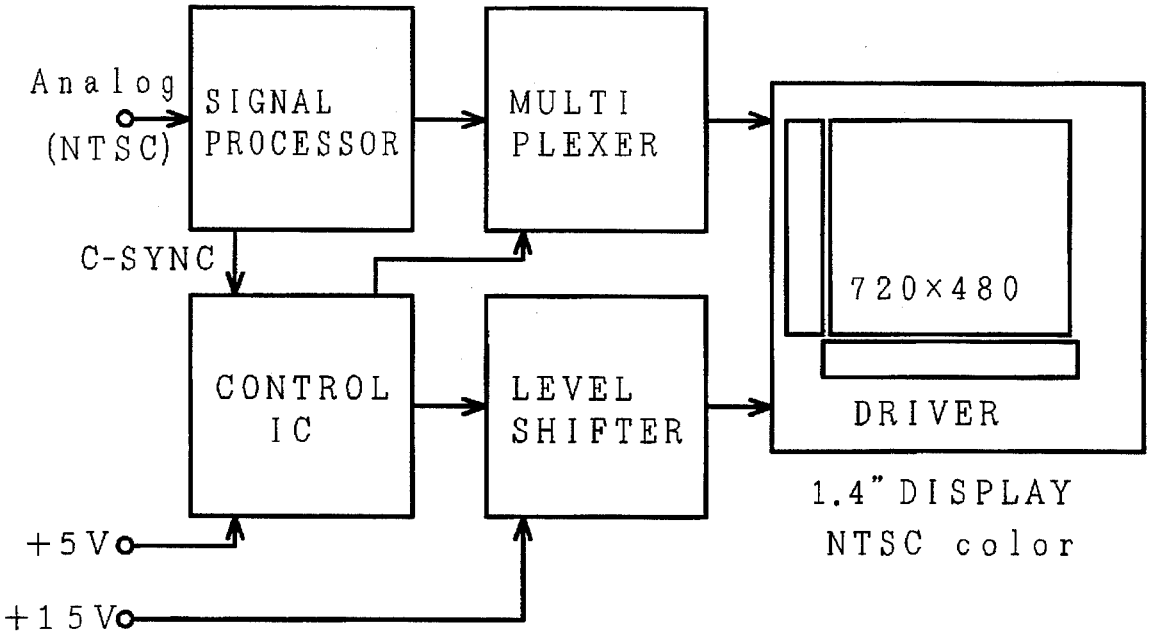
FIG. 6 is a block diagram illustrating a display device using the TFT display device according to the embodiment of the present invention.

FIG. 6 is a block diagram illustrating a display device using the TFT display according to the embodiment of the present invention. The TFT display of this embodiment contains a highly fine display unit having 720×480 pixels and a drive circuit for driving the signal lines and scanning lines.

The analog signals of the NTSC system pass through a signal processing IC, separated into color video signals R, G and B through a multiplexer, inverted for their polarities for each of the fields, and are input as pixel signals.

A control IC receives synchronizing signals C-SYNC included in the composite video signals of the above NTSC system, forms pixel clocks corresponding to the number of pixels, i.e., 720 in the horizontal direction, and inputs them to the multiplexer so that they are separated into color video signals which can be used as the above-mentioned color signals. The control IC further feeds signals to a level-shifting IC to form timing signals such as shift clocks and start pulses having levels necessary for the driving operation, which are then fed to the TFT display device.

Operations and effects exhibited by the above-mentioned embodiment are as described below.

(1) A display device comprising TFT transistors of which the gates are connected to the scanning lines and of which the drains are connected to the signal lines that are so formed as to intersect one another substantially at right angles, a TFT display panel having pixel electrodes provided at sources of the TFT transistors, a signal line drive circuit which is formed on the display panel and permits pixel signals that are serially input to be output in parallel, and a scanning line drive circuit which is formed on the display panel and simultaneously selects the two neighboring scanning lines while changing the combination thereof for each of the fields, wherein for the pixels of two rows that are simultaneously selected by the scanning line drive circuit, the signal written into the pixels corresponding to one row has a polarity opposite to that of the signal written into the pixels corresponding to the other row. Therefore, despite the two rows are simultaneously selected, signals of opposite polarities are fed to these rows, whereby flickering decreases and noise transmitted to the signal lines and to a common plate electrode is canceled, making it possible to accomplish stable display operation.

(2) The signal lines are grouped into odd-number rows and even-number rows, shift registers are provided in a number of N for every N signal lines, the frequency of pixel signal clocks is divided into ½N for the 2N shift registers, start pulses are successively shifted by 2N shift clocks having a phase deviated by one pixel clock in order to successively select the signal lines. Therefore, the shift clocks of the shift registers are greatly decreased to ½N, and a number of signal lines are highly finely driven maintaining a sufficiently large operation margin by a drive circuit that is formed integrally with the display unit using the poly-Si film.

(3) A pair of drain lines provided for an even number and an odd number are arranged in an overlapped manner on the upper portion of a holding capacity Cadd, and are divided on a next row into the right and left with a pixel electrode CLC being formed therebetween. In a portion where the pixel electrode is formed, the pair of signal lines are arranged being neighbored to one of the neighboring pairs of signal lines. Therefore, the aperture (CLC) of the pixel can be broadened to improve light utilization factor of the display panel.

In the foregoing was concretely described the invention accomplished by the present inventors by way of an embodiment, but is should be noted that the present invention is in no way limited to the above-mentioned embodiment only but can be modified in a variety of ways without departing from the spirit and scope of the invention. For instance, a pair of drain lines can be constituted in a variety of forms. In addition to being divided into six described above, the shift register may be realized in a variety of forms depending upon the characteristics of MOSFETs formed on the same substrate and the frequency that is determined depending upon the number of signal lines formed on the display unit. The poly-Si film may be formed on the glass substrate via, for example, an amorphous film.

The present invention can be extensively adapted for the TFT display devices in which the display unit and the drive unit uses a poly-Si film that is formed on the same glass substrate or quartz substrate.

What is claimed is:

1. A liquid crystal display device having a thin film transistor comprising:

an insulating substrate;

scanning lines, signal lines and pixels formed over said substrate;

a scanning line drive circuit which is formed over said substrate and simultaneously selects two neighboring scanning lines while changing the combination thereof for each of the fields; and a signal line drive circuit which is formed over said substrate and outputs such signals that a signal written into pixels corresponding to one of said selected scanning lines has a polarity opposite to that of a signal written into pixels corresponding to the other of said selected scanning lines.

2. A liquid crystal display device having a thin film transistor according to claim 1, wherein said signal line drive circuit comprises N shift registers corresponding to every N signal lines of odd-number rows and N shift registers corresponding to every N signal lines of even-number rows, wherein 2N shift registers have frequency of pixel clocks divided into ½N and successively shift start pulses in response to 2N shift clocks having phases each deviated by one pixel clock, in order to successively select said signal lines.

3. A liquid crystal display device having a thin fill transistor according to claim 1, wherein said signal line drive circuit comprises a sample-holding circuit that transmits pixel signals of opposite polarities to said signal lines.

4. A liquid crystal display device having a thin fill transistor according to claim 1, wherein said scanning line drive circuit comprises shift registers corresponding to odd-number rows and shift registers corresponding to even-number rows.

5. A liquid crystal display device having a thin fill transistor according to claim 1, wherein said scanning line drive circuit is connected to shift clocks corresponding to odd-number rows and shift clocks corresponding to even-number rows.

6. A liquid crystal display device having a thin fill transistor according to claim 1, wherein said scanning line device circuit is connected to start pulses corresponding to odd-number rows and start pulses corresponding to even-number rows.

7. A liquid crystal display device having a thin fill transistor according to claim 1, wherein the transistors constituting said signal line drive circuit and said scanning line drive circuit are formed on a polycrystalline silicon fill that is formed on a glass substrate or a quartz substrate.

8. A method of driving a liquid crystal display device having a thin film transistor comprising:

means for simultaneously selecting two scanning lines and pixels of two rows corresponding to said scanning lines;

means for selecting a set of two scanning lines that are simultaneously selected in a manner that is different depending upon a first field and a second field; and means which, for the pixels of two rows simultaneously selected by said scanning line drive circuit, provides a signal written into pixels corresponding to one row with a polarity opposite to that of a signal written into pixels corresponding to the other row;

wherein said means for selecting a set of two scanning lines that are simultaneously selected in a manner that is different depending upon a first field and a second field further works to simultaneously generate start pulses for odd-number rows and start pulses for even-number rows in one of said first field or second field and to generate, in the other field, start pulses for odd-number rows or start pulses for even-number rows being delayed by a period of a horizontal synchronizing signal.

* * * * *